US010309424B1

(12) United States Patent
Mason et al.

(10) Patent No.: US 10,309,424 B1
(45) Date of Patent: Jun. 4, 2019

(54) VEHICLE FUEL PUMP MODULE INCLUDING IMPROVED JET PUMP ASSEMBLY

(71) Applicants: Robert Bosch LLC, Broadview, IL (US); Robert Bosch GmbH, Stuttgart (DE)

(72) Inventors: Paul Mason, Dearborn, MI (US); David Toutant, Grosse Pointe Woods, MI (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/818,320

(22) Filed: Nov. 20, 2017

(51) Int. Cl.

| | |
|---|---|
| ***F02M 37/18*** | (2006.01) |
| ***F04F 5/48*** | (2006.01) |
| ***F02M 37/00*** | (2006.01) |
| ***F02M 37/12*** | (2006.01) |

(52) U.S. Cl.
CPC ..... *F04F 5/48* (2013.01); *F02M 37/007* (2013.01); *F02M 37/0094* (2013.01); *F02M 37/12* (2013.01); *F02M 37/18* (2013.01)

(58) Field of Classification Search
CPC ..... F02M 37/025; F02M 37/106; F04F 5/00; F04F 5/46; F04F 5/466
See application file for complete search history.

(56) References Cited

U.S. PATENT DOCUMENTS

| | | | | |
|---|---|---|---|---|
| 5,901,742 | A * | 5/1999 | Kleppner | F02M 69/54 137/508 |
| 6,415,771 | B1 * | 7/2002 | Mihatsch | F02M 37/025 123/514 |
| 8,459,960 | B2 * | 6/2013 | Mason | F04F 5/10 123/510 |
| 8,852,443 | B2 | 10/2014 | Forrest et al. | |
| 9,546,670 | B2 | 1/2017 | Malec | |
| 2002/0083983 | A1 * | 7/2002 | Coha | F02M 37/0094 137/565.22 |
| 2003/0226548 | A1 * | 12/2003 | Herzog | B60K 15/077 123/514 |
| 2006/0076287 | A1 * | 4/2006 | Catlin | B01D 35/0273 210/416.4 |
| 2009/0304527 | A1 * | 12/2009 | Wattai | F02M 37/025 417/151 |

(Continued)

FOREIGN PATENT DOCUMENTS

| | | |
|---|---|---|
| DE | 19856298 | 2/2000 |
| GB | 2099930 | 8/1984 |

*Primary Examiner* — Long T Tran
(74) *Attorney, Agent, or Firm* — Kelly McGlashen; Maginot Moore & Beck LLP

(57) ABSTRACT

A vehicle fuel pump module includes a jet pump assembly and feed tube that delivers fuel to the assembly. The module includes a jet pump choke that is disposed in the jet pump assembly and provides a reduction of pressure of fluid within the jet pump assembly. The jet pump choke includes include a choke housing that defines a passageway that extends between a fluid inlet and outlet, and a slot that is formed in a surface of the passageway. A ball is fixed within and obstructs the passageway, and abuts the slot. A fluid path defined between the ball and surfaces of the slot provides fluid communication between the fluid inlet and outlet of the choke housing.

7 Claims, 7 Drawing Sheets

(56) References Cited

U.S. PATENT DOCUMENTS

2013/0160877 A1* 6/2013 Walter ..... B60K 15/03504
137/565.22
2015/0273369 A1 10/2015 Le Ven et al.

* cited by examiner

VEHICLE FUEL PUMP MODULE INCLUDING IMPROVED JET PUMP ASSEMBLY

FIELD OF THE INVENTION

The present invention relates to vehicle fuel systems, and more particularly to vehicle fuel systems including jet pump assemblies.

BACKGROUND OF THE INVENTION

The use of bifurcated fuel tanks, also commonly referred to as saddle tanks, in conjunction with fuel delivery systems having a single fuel pump is known. In such systems, a reservoir surrounds the fuel pump and is constantly filled to ensure that a steady supply of fuel is available to the pump at all times. Normally, fuel is drawn into the fuel pump from the bifurcated tank portion housing the fuel pump, but if the fuel level is low or vehicle maneuvering is such that the fuel pump inlet cannot draw fuel, the fuel pump instantly draws fuel from the reservoir. A jet pump is typically used to draw fuel from the opposing bifurcated portion of the tank through a crossover line and into the reservoir. Fuel typically overflows the reservoir and excess fuel fills the bifurcated tank portion housing the fuel pump. This ensures that fuel is available to the fuel pump regardless of the level of fuel in either of the bifurcated tank portions.

Some fuel systems include a filtering choke in the fuel supply line that supplies the jet pump. The filtering choke functions to provide a pressure drop by restricting flow through an orifice. In addition, the filtering choke functions to filter the fuel in the fuel supply line to prevent debris from clogging the choke orifice or other orifices downstream. However, manufacture of a filtering choke via a molding operation is challenging since the orifices that form the choke and filter are often at a lower limit of sizes that can be formed in a molding operation.

SUMMARY OF THE INVENTION

In some aspects, a vehicle fuel pump module includes a reservoir configured to be disposed in a fuel tank of the vehicle, and a jet pump assembly that is disposed in the reservoir. The jet pump assembly comprises a fluid supply conduit, an internal chamber, a primary jet pump, and a passageway. The primary jet pump includes a primary nozzle and a primary mixing tube. The primary nozzle includes a primary nozzle inlet that communicates with the fuel supply conduit and a tapered primary nozzle outlet. The primary mixing tube receives fluid discharged from the primary nozzle outlet and is in fluid communication with the internal chamber. The passageway extends between the fuel supply conduit and the primary nozzle inlet. The passageway is parallel to a direction of fluid flow through the fuel supply conduit and perpendicular to a longitudinal axis of the primary nozzle. The passageway includes a jet pump choke that is configured to provide a reduced pressure at the primary nozzle inlet relative to a pressure in the fluid supply conduit. The jet pump choke includes a choke ball disposed in the passageway, and a choke slot that is formed in the inner surface of the passageway. The choke slot extends along a direction that is perpendicular to the longitudinal axis of the primary nozzle. The choke ball is dimensioned to be press fit within the passageway such that the choke ball is fixed within the passageway and fully obstructs the passageway. In addition, a fluid path is defined between the choke ball and surfaces of the choke slot, the fluid path providing fluid communication between the fuel supply conduit and the primary nozzle inlet.

In some embodiments, a first area is defined by a cross section of the fluid path that is perpendicular to a direction of fluid flow through the fluid path, and a second area is defined by a cross section of the passageway that is perpendicular to a direction of fluid flow through the passageway, and the first area is less than the second area.

In some embodiments, the jet pump assembly comprises a secondary jet pump that includes a secondary nozzle and a secondary mixing tube. The secondary nozzle includes a secondary nozzle inlet that communicates with the fuel supply conduit and a tapered secondary nozzle outlet. The secondary mixing tube is configured to receive fluid that has been discharged from the secondary nozzle, and the jet pump choke is disposed between the secondary nozzle inlet and the primary nozzle inlet.

In some embodiments, the secondary mixing tube is configured to receive a first portion of fluid that has been discharged from the secondary nozzle outlet and receive a second portion of fluid that is drawn from a portion of a fuel tank of the vehicle, and discharge the first and second portions of fluid to the reservoir.

In some embodiments, the secondary mixing tube is configured to discharge fluid received from the secondary nozzle to the reservoir via a standpipe having an outlet that resides at location corresponding to an open end of the reservoir.

In some embodiments, the vehicle fuel pump module includes a jet pump feed tube that is connected to the jet pump assembly. The jet pump feed tube includes a feed tube inlet, a feed tube outlet that is connected to and communicates with the fluid supply conduit, and a feed tube passageway that extends between the feed tube inlet and the feed tube outlet. A filtering choke is disposed within the feed tube passageway at a location between the feed tube inlet and the feed tube outlet. The filtering choke includes a choke housing that includes a fluid inlet, a fluid outlet, a choke housing passageway that extends between the fluid inlet and the fluid outlet, a choke housing longitudinal axis that extends between the fluid inlet and the fluid outlet, and a filter slot that is formed in a surface of the choke housing passageway. The filter slot extends in parallel to the choke housing longitudinal axis, and a filter ball is disposed in the choke housing passageway. The filter ball is dimensioned to be press fit within the choke housing passageway at a location corresponding to the location of the filter slot such that the filter ball is fixed within the choke housing passageway and abuts the filter slot. In addition, a fluid path is defined between the filter ball and surfaces of the filter slot, the fluid path providing fluid communication between the feed tube inlet and the feed tube outlet.

In some embodiments, the filtering choke is formed by a molding process in which slots are formed in a fluid passageway upstream relative to an orifice plate that serves as a choke orifice. The slots extend in the direction of fluid flow through the passageway, and a ball is press fit into the passageway at a location corresponding to the slots. As a result, the ball is fixed within the passageway and fully obstructs and closes the passageway. In addition, fluid within the passageway is diverted through the slots, which provide a fluid path around the ball. The slots are dimensioned to be the same size or smaller than the choke orifice, and thus the ball and slots cooperate to provide a filtering function that prevents debris from clogging the choke orifice or other orifices downstream. In particular, the cross sectional dimensions of the slot determine the filtration efficiency of the filtering choke. In the filtering choke, the fluid flow direction is unchanged, whereby the filtering choke can be installed inline in an existing flow channel.

In some aspects, a vehicle fuel pump module includes a reservoir configured to be disposed in a fuel tank of the vehicle; and a jet pump assembly that is disposed in the reservoir. The jet pump assembly comprises a fluid supply conduit, an internal chamber, a primary jet pump, and a secondary jet pump. The primary jet pump includes a primary nozzle and a primary mixing tube. The primary nozzle includes a primary nozzle inlet that communicates with the fuel supply conduit and a tapered primary nozzle outlet. The primary mixing tube receives fluid discharged from the primary nozzle outlet and is in fluid communication with the internal chamber. The secondary jet pump includes a secondary nozzle and a secondary mixing tube. The secondary nozzle includes a secondary nozzle inlet that communicates with the fuel supply conduit and a tapered secondary nozzle outlet. The secondary mixing tube is configured to receive fluid that has been discharged from the secondary nozzle. The jet pump assembly also includes a jet pump choke that is disposed in the fuel supply conduit at a location between the secondary nozzle inlet and the primary nozzle inlet. The jet pump choke is configured to provide a reduced pressure at the primary nozzle inlet relative to a pressure in at the secondary nozzle inlet, and includes a choke housing that defines a passageway, a choke ball disposed in the passageway, and a choke slot that is formed in the inner surface of the passageway. The choke slot extends along a direction that is perpendicular to the longitudinal axis of the primary nozzle. The choke ball is dimensioned to be press fit within the passageway such that the choke ball is fixed within the passageway and fully obstructs the passageway, and a fluid path is defined between the choke ball and surfaces of the choke slot, the fluid path providing fluid communication between the fuel supply conduit and the primary nozzle inlet.

The filtering choke formed of a ball fixed within a slotted passageway is both easier and less expensive to manufacture and assemble than some conventional filtering chokes that are formed by overmolding a mesh filter to be disposed in the passageway upstream of the choke orifice.

In some embodiments, a choke is formed by a molding process in which a slot is formed in a fluid passageway. The slot extends in the direction of fluid flow through the passageway, and a ball is press fit into the passageway at a location corresponding to the slot. As a result, the ball is fixed within the passageway and fully obstructs and closes the passageway. In addition, fluid within the passageway is diverted through the slot, which provides a fluid path around the ball. The slot is shaped and/or dimensioned to provide a required pressure drop in the same way as does the aperture of an orifice plate. As a result, the ball and slot cooperate to provide a choke function that provides a predetermined pressure drop within the passageway.

Other features and aspects of the invention will become apparent upon consideration of the following detailed description and accompanying drawings.

It is understood that the invention is not limited in its application to the details of construction and the arrangement of components set forth in the following description or illustrated in the following drawings. The invention is capable of having other embodiments and of being practiced or of being carried out in various ways. Also, it is understood that the phrases and terms used herein are for the purpose of description and should not be regarded as limiting.

DETAILED DESCRIPTION

Figure 1:
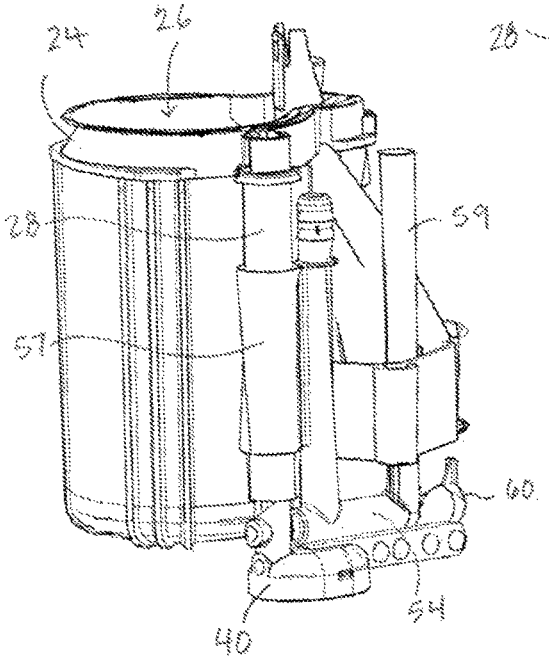
FIG. 1 is a perspective view of a filter housing and jet pump assembly of a vehicle fuel pump module.
Figure 2:
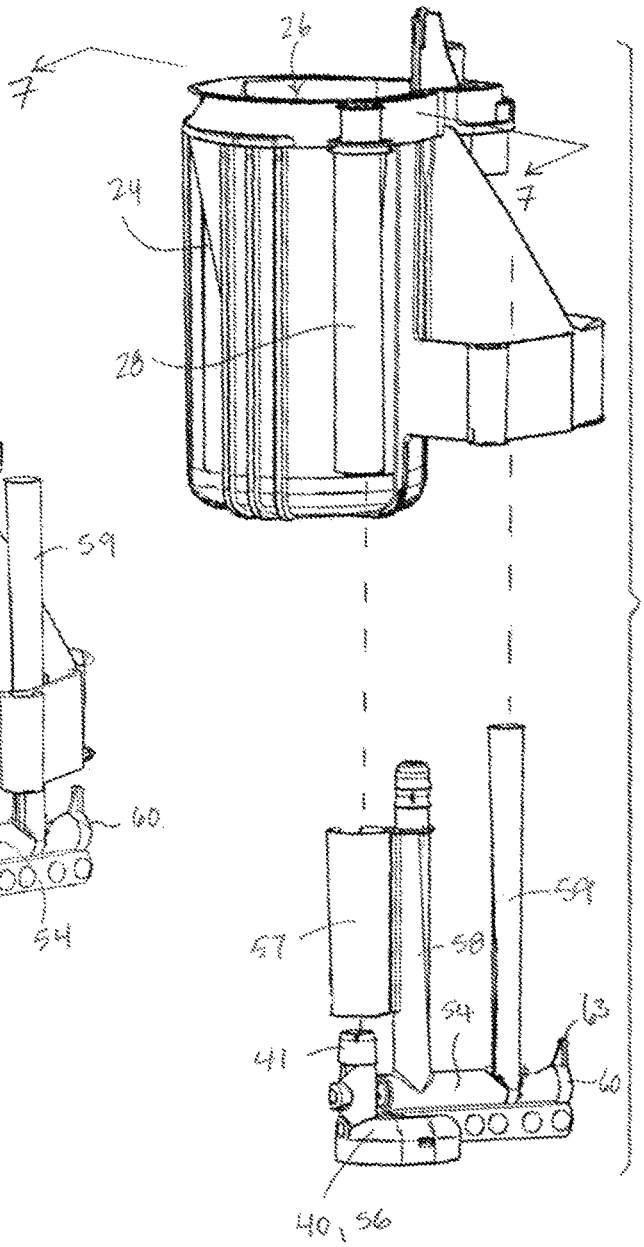
FIG. 2 is an exploded perspective view of the filter housing and jet pump assembly of FIG. 1.
Figure 3:
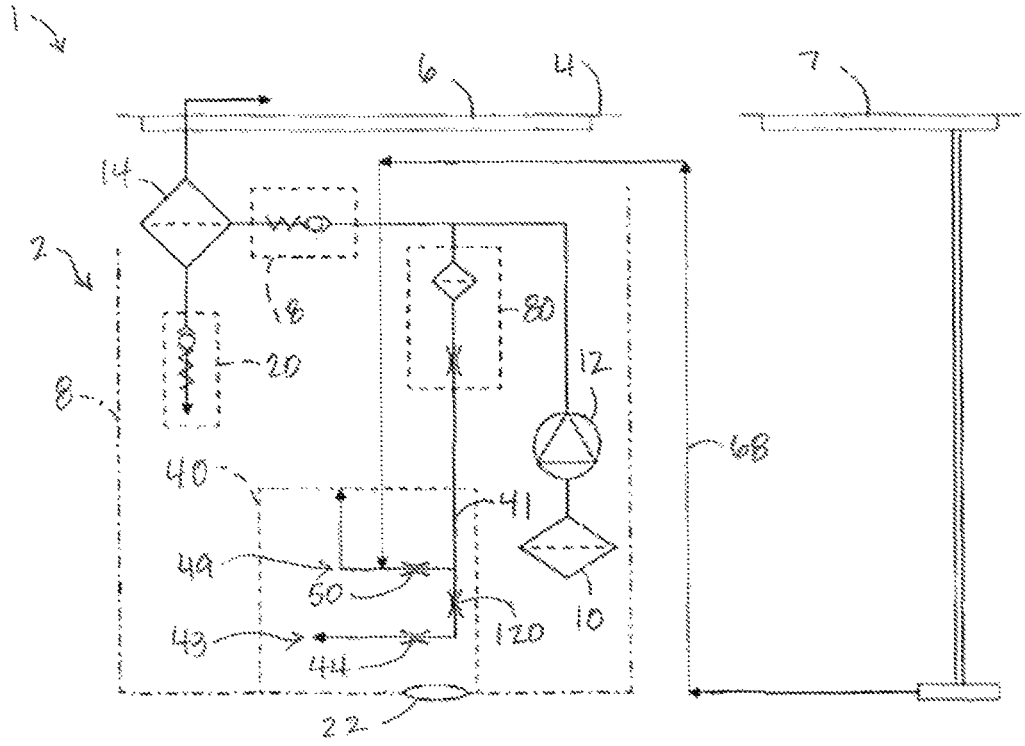
FIG. 3 is a schematic diagram of a fuel system including the jet pump assembly of FIG. 1.

Referring to FIGS. 1-3, a vehicle fuel system 1 used to provide fuel to an internal combustion engine (not shown) includes a fuel pump module 2 that is disposed in a vehicle fuel tank, for example a saddle-style fuel tank 4. The fuel pump module 2 includes a reservoir 8 that contains a fuel pump 12, a fuel pump filter 10 supported in a filter housing 24, a secondary filter 14, a check valve 18, a fuel pressure regulator 20 and a jet pump assembly 40. The fuel pump module 2 is positioned on a primary side 6 of the saddle-style fuel tank 4. As described in more detail below, the jet pump assembly 40 draws fuel from both the primary side 6 of the fuel tank and a secondary side 7 of the fuel tank 4 into the reservoir 8 to fill the reservoir 8 and substantially immerse the fuel pump 12 with fuel. This allows the fuel pump 12 to access a substantially continuous supply of fuel regardless of the level of fuel in the primary side 6 or the secondary side 7 of the fuel tank 4.

Figure 6:
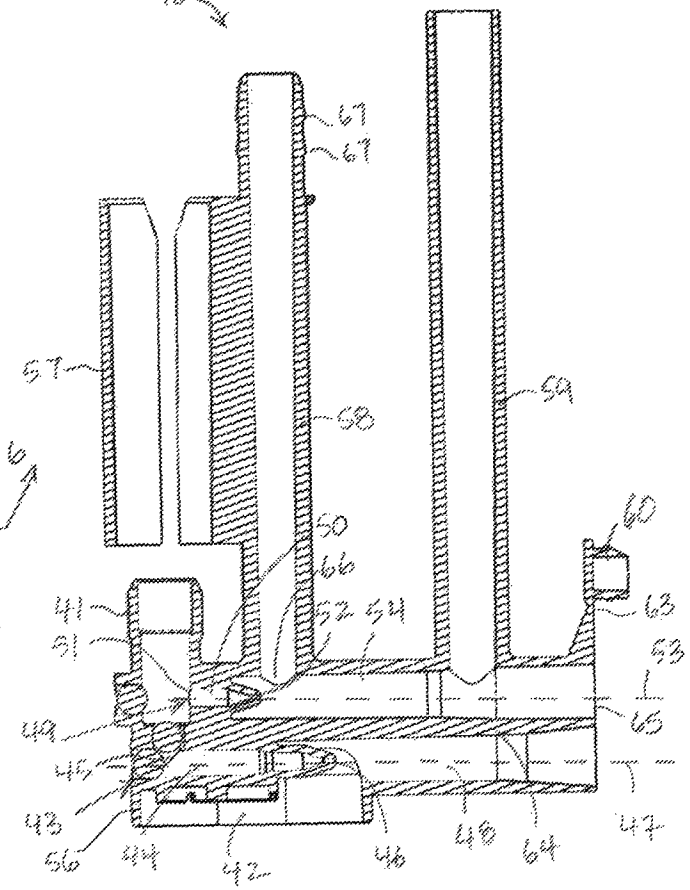
FIG. 6 is a cross-sectional view of the jet pump assembly as seen along line 6-6 of FIG. 5.
Figure 5:
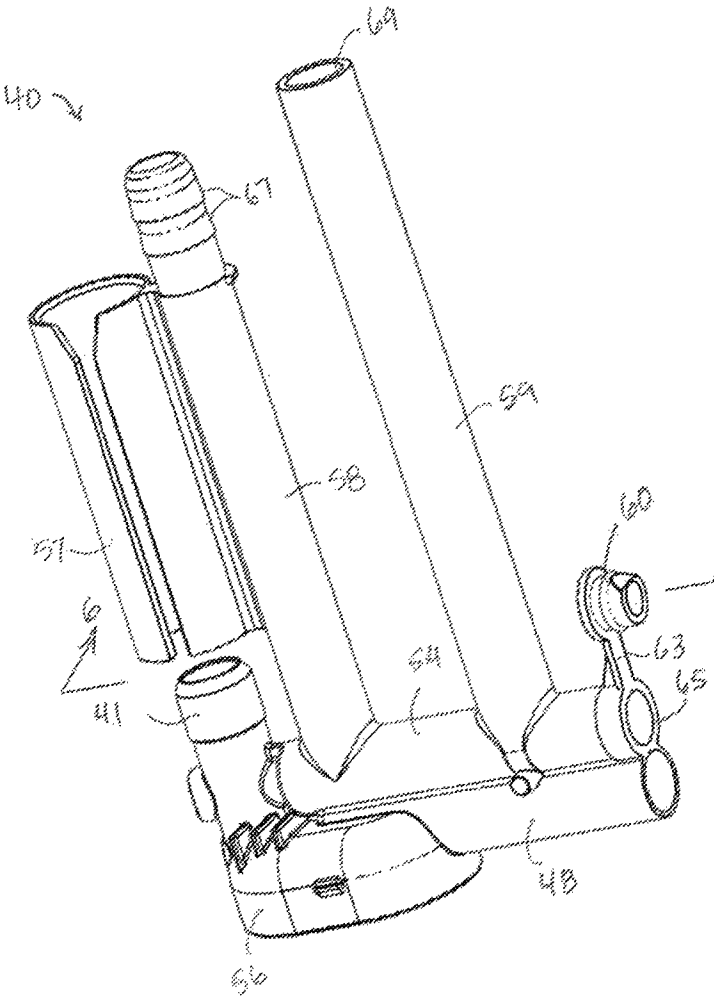
FIG. 5 is a perspective view of the jet pump assembly of FIG. 1.

Referring to FIGS. 3, 5 and 6, the jet pump assembly 40 includes a fuel supply conduit 41 and a primary jet pump 43 integrally formed as a single piece with the fuel supply conduit 41 and oriented substantially normal to the fuel supply conduit 41. The primary jet pump 43 is in fluid communication with the fuel supply conduit 41 to receive pressurized fuel from the fuel supply conduit 41 during operation of the fuel pump 12. As seen in FIG. 3, the fuel supply conduit 41 receives pressurized fuel directly from the output of the fuel pump 12 via a filtering choke 80 positioned upstream of the fuel supply conduit 41 to reduce the pressure of the pressurized fuel delivered to the fuel supply conduit 41. As used herein, the terms "upstream" and "downstream" are used with reference to a direction of fluid flow through the respective device. The filtering choke 80 will be described in detail below.

Figure 4:
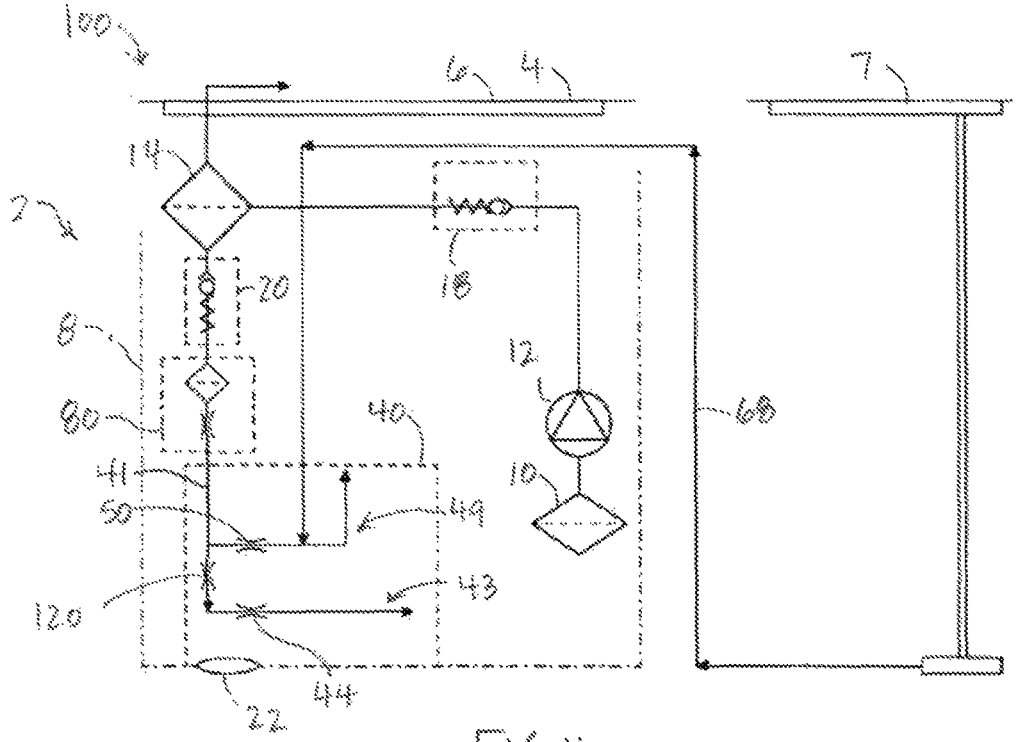
FIG. 4 is a schematic diagram of an alternative embodiment fuel system including the jet pump assembly of FIG. 1.

Referring to FIG. 4, the jet pump assembly 40 may alternatively be configured within the fuel pump module such that the fuel supply conduit 41 receives "return" fuel from the fuel pressure regulator 20 to power the primary jet pump 43. The fuel pump 12 is sized to deliver fuel to the engine at a maximum flow rate and pressure. The fuel pressure regulator 20 provides a regulated supply of fuel to the engine that is often less than the maximum flow rate and pressure that the fuel pump 12 is capable of providing. The fuel pressure regulator 20, therefore, returns excess fuel that is not needed by the engine to the reservoir 8 to fill the reservoir 8. More particularly, the excess or return fuel from the fuel pressure regulator 20 is directed to the fuel supply conduit 41 via the filtering choke 80, and is used to power the primary jet pump 43 before being returned to the reservoir 8.

Figure 7:
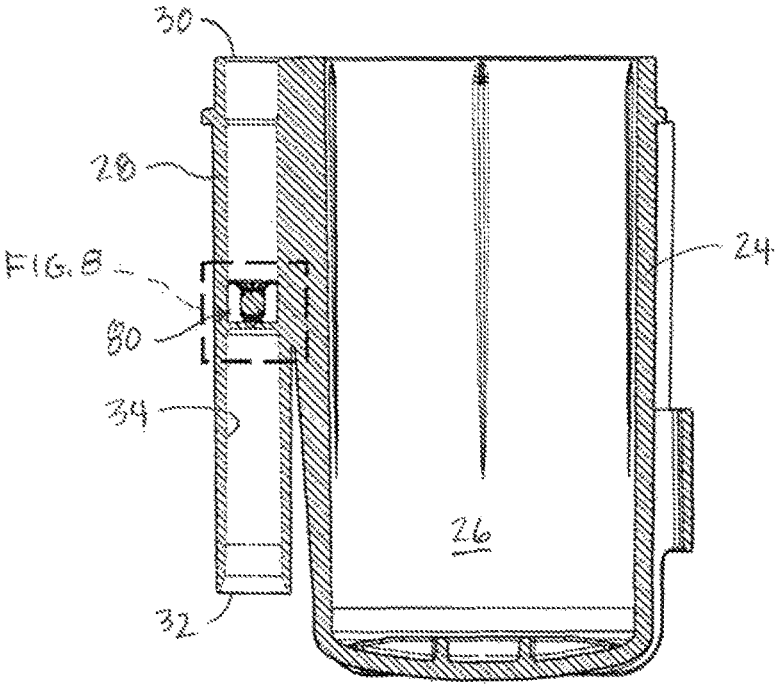
FIG. 7 is a cross-sectional view of the filter housing as seen along line 7-7 of FIG. 2.
Figure 8:
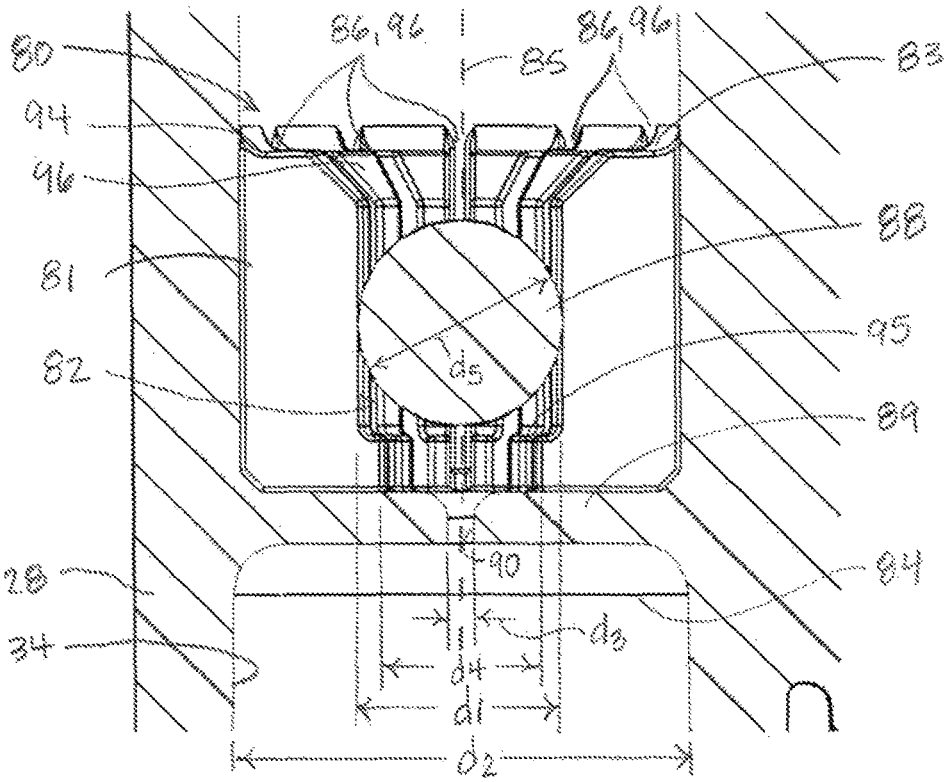
FIG. 8 is a detail view of a portion of the filter housing of FIG. 7.

Referring to FIGS. 7 and 8, the filtering choke 80 is disposed in a jet pump feed tube 28 that supplies fuel to the fuel supply conduit 41. The jet pump feed tube 28 is a tube that is secured to an outer surface of the filter housing 24 so as to be aligned with a vertical axis, and has a feed tube inlet 30 at one end and a feed tube outlet 32 at an opposed end. Here, reference to a vertical axis is made with respect to the orientation of the device as illustrated in the figures, and with respect to the orientation of the device when installed in a vehicle that is supported on a level surface. The jet pump feed tube 28 includes a feed tube passageway 34 that extends between the feed tube inlet 30 and the feed tube outlet 32. The feed tube outlet 32 is connected to the fuel supply conduit 41, whereby the jet pump feed tube delivers fuel to the fuel supply conduit 41.

The filtering choke 80 is disposed in the jet pump feed tube 28 at a location between the feed tube inlet 30 and the feed tube outlet 32. In the illustrated embodiment, the filtering choke 80 is positioned mid-way between the feed tube inlet 30 and feed tube outlet 32, but is not limited to the mid-way position. The filtering choke 80 includes a filtering choke housing 81, a filter ball 88 that is disposed in the filtering choke housing 81, and an orifice plate 89 disposed in the filtering choke housing 81 at a location downstream of the filter ball 88. The filtering choke housing 81 is formed integrally with a surface of the feed tube passageway 34. The filtering choke housing 81 includes a fluid inlet 83, a fluid outlet 84 and a choke housing longitudinal axis 85 that extends between the fluid inlet 83 and the fluid outlet 84. The choke housing longitudinal axis 85 is aligned with the direction of fluid flow through the jet pump feed tube 28, e.g., aligned with a vertical axis. The filtering choke housing 81 defines a choke housing passageway 82 that extends between the fluid inlet 83 and the fluid outlet 84.

Adjacent to the fluid inlet 83, the choke housing passageway 82 has a first cross-sectional dimension, for example a first diameter d1, that is less than a corresponding dimension, for example a second diameter d2, of the feed tube passageway 34, whereby a first shoulder 94 is formed within the feed tube passageway 34 at the fluid inlet 83. In some embodiments, the first shoulder 94 may include a beveled portion 96 at the intersection of the shoulder 94 with the choke housing passageway 82. The beveled portion 96 facilitates insertion of the filter ball 88 into the choke housing passageway 82 during manufacture of the filter choke 80.

The filtering choke housing 81 also includes several filter slots 86 that are formed in a surface of the choke housing passageway 82. In the illustrated embodiment, fourteen filter slots 86 are provided, but a greater or fewer number of filter slots 86 can be used as is required by the specific application. The filter slots 86 are spaced apart about a circumference of the choke housing passageway 82, and extend in parallel to the choke housing longitudinal axis 85. In the illustrated embodiment, the filter slots 86 are equidistantly spaced apart about the circumference of the choke housing passageway 82, but are not limited to this configuration.

The filter ball 88 is disposed in the choke housing passageway 82 at a location corresponding to the location of the filter slots 86. The filter ball 88 is dimensioned to be press fit within the choke housing passageway 82 such that the filter ball 88 is fixed within the choke housing passageway 82 and abuts the filter slots 86. In particular, the filter ball 88 is fixed within the choke housing passageway 82 and fully obstructs fluid flow within the housing passageway 82. However, a filtering choke fluid path 96 is defined between the filter ball 88 and surfaces of the filter slots 86. The filtering choke fluid path 96 provides fluid communication between the choke housing fluid inlet 83 and the choke housing fluid outlet 84, and thus also between the feed tube inlet 30 and the feed tube outlet 32.

To provide a filtering function, the filter slots 86 are dimensioned such that objects of a predetermined size are prevented from entering the fluid path 96. For example, in the illustrated embodiment, the filtering slots 86 are dimensioned to be the same size or smaller than an aperture 90 of the orifice plate 89, to ensure that the orifice plate aperture 90 does not become obstructed by particles or debris in the fuel.

In addition to the filtering choke housing 81 and the filter ball 88, the filtering choke 80 also includes the orifice plate 89. The orifice plate 89 is an annular plate that is disposed in the filtering choke housing 81 between the filter slots 86 and the fluid outlet 84. The orifice plate 89 is oriented transverse to the choke housing longitudinal axis 85, and protrudes integrally from the filtering choke housing 81. In the illustrated embodiment, the filter slots 86 terminate at the orifice plate 89. The orifice plate 89 defines the aperture 90, which serves a pressure reduction function. As such, a diameter d3 of the aperture 90 is set based on an amount of pressure reduction that is required within the feed tube 28 as determined by the specific application. For example, the filtering choke 80 may reduce the pressure of the pressurized fuel delivered to the fuel supply conduit 41 from about 5 bars to about 3 bars. Alternatively, the filtering choke 80 may be configured to reduce the pressure of the pressurized fuel delivered to the fuel supply conduit 41 by a different amount.

Adjacent to, and upstream of, the orifice plate 89, the choke housing passageway 82 has a relatively reduced cross-sectional dimension, for example having a fourth diameter d4, that is less than a corresponding dimension of the choke housing passageway 82 adjacent to the fluid inlet 83, e.g., the first diameter d1. As a result, a second shoulder 95 is formed within the feed tube passageway 34. Thus, the choke housing passageway 82 has a reduced diameter portion at the location at which it intersections the orifice plate 89. The fourth diameter d4 is less than the diameter d5 of the filter ball 88. In addition, the second shoulder 95 is spaced apart from the orifice plate 89 along the choke housing longitudinal axis 85, and serves to prevent the filter ball 88 from contacting the orifice plate 89 and obstructing the aperture 90.

Referring again to FIGS. 3, 5 and 6, the jet pump assembly 40 includes a base 56 integrally formed as a single piece with the fuel supply conduit 41 and the primary jet pump 43. The base 56 defines an internal chamber 42 having an opening adjacent the bottom of the base 56 through which fuel is drawn in response to fuel being discharged through the primary jet pump 43. The reservoir 8 includes a receptacle (not shown) sized to receive the base 56 therein. An interference fit between the receptacle and the base 56 of the jet pump assembly 40 may be employed to at least partially secure the jet pump assembly 40 to the reservoir 8. Alternatively, any of a number of different fasteners or processes may be employed to secure the jet pump assembly 40 to the reservoir 8 (e.g., using screws, quick-connect structures, welding, adhesives, etc.).

A one-way valve 22 (for example, an umbrella-style valve) is coupled to the bottom of the reservoir 8 and is positioned within the internal chamber 42 of the base 56. As is discussed in more detail below, the discharge of fuel through the primary jet pump 43 creates a region of low pressure within the internal chamber 42, thereby opening the one-way valve 22 to allow fuel in the primary side 6 of the fuel tank 4 to be drawn into the internal chamber 42 and subsequently mixed with the fuel discharged through the primary jet pump 43 within the primary mixing tube 48. The mixed fuel is then discharged into the reservoir 8 to fill the reservoir 8. However, shortly after de-activation of the fuel pump 12, fuel stops flowing through the primary jet pump 43, allowing the pressure exerted on each side of the one-way valve 22 to equalize which, in turn, allows the valve 22 to close. When the valve 22 is closed, fuel in the reservoir 8 is prevented from back-flowing through the primary jet pump 43 and siphoning to the primary side 6 of the fuel tank 4.

The primary jet pump 43 also includes a primary nozzle 44 positioned adjacent the internal chamber 42 of the base 56 and a primary mixing tube 48. The primary nozzle 44 includes a primary nozzle inlet 45 at one end that communicates with the fuel supply conduit 41, and a tapered primary nozzle outlet 46 at an opposed end. A longitudinal axis 47 of the primary jet pump 43 extends between the primary nozzle inlet 45 and the primary nozzle outlet 46, and is perpendicular to the direction of fluid flow through the fuel supply conduit 41. The primary nozzle 44 discharges into the primary mixing tube 48, which is aligned with the primary jet pump longitudinal axis 47.

As described above, discharge of fuel through the primary nozzle 44 creates a region of low pressure within the internal chamber 42 to open the one-way valve 22 and draw fuel from the primary side 6 of the fuel tank 4 into the chamber 60, where the fuel is mixed with fuel discharged through the primary nozzle 44 in the primary mixing tube 48. The mixed fuel is then discharged from the primary mixing tube 48 into the reservoir 8.

The jet pump assembly 40 also includes a second or secondary jet pump 49. In the illustrated embodiment, the secondary jet pump 49 is integrally formed as a single piece with the fuel supply conduit 41. The secondary jet pump 49 includes a secondary nozzle 50 positioned adjacent the fuel supply conduit 41 and overlying the primary nozzle 44, and a secondary mixing tube 54. The secondary nozzle 50 includes a secondary nozzle inlet 51 at one end that communicates with the fuel supply conduit 41 at a location upstream relative to the primary nozzle inlet 45. The secondary nozzle 50 includes a tapered secondary nozzle outlet 52 at an opposed end relative to the secondary nozzle inlet 51. A longitudinal axis 53 of the secondary jet pump 49 extends between the secondary nozzle inlet 51 and the secondary nozzle outlet 52, and is perpendicular to the direction of fluid flow through the fuel supply conduit 41. The secondary nozzle 50 discharges into the secondary mixing tube 54, which is aligned with the secondary jet pump longitudinal axis 53.

The secondary jet pump 49 is in fluid communication with the fuel supply conduit 41 to receive pressurized fuel from the fuel supply conduit 41 during operation of the fuel pump 12. As shown in FIG. 6, the primary and secondary jet pumps 43, 40 are fluidly connected to the fuel supply conduit 41 in a parallel arrangement.

Figure 9:
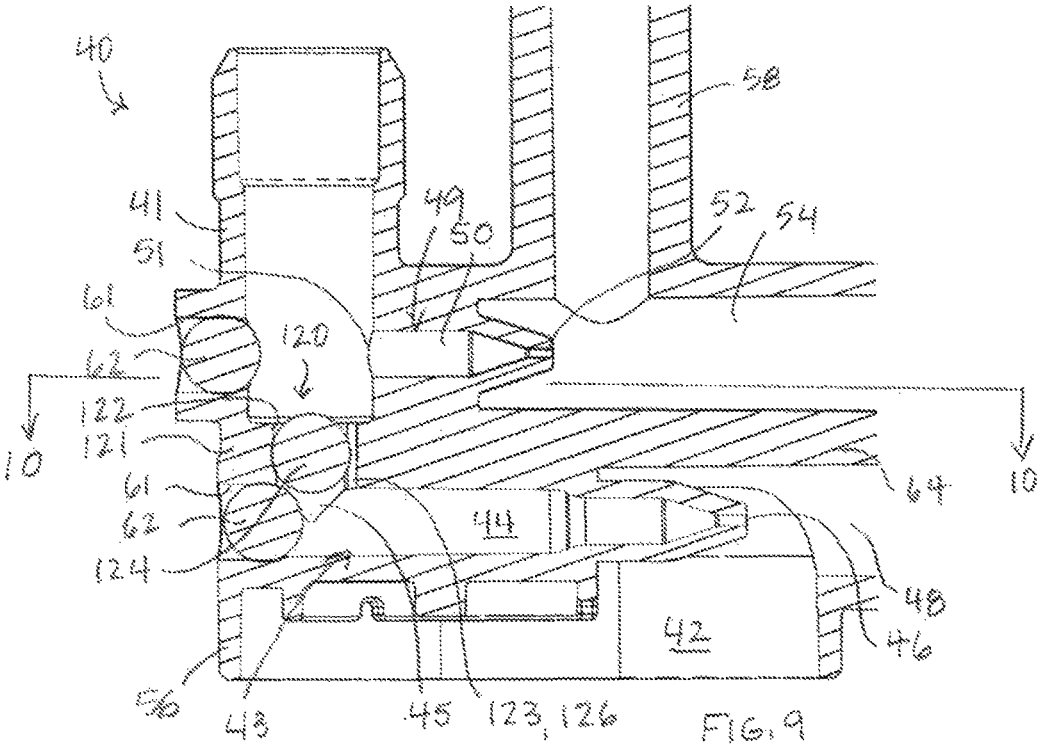
FIG. 9 is a detail view of a portion of the jet pump assembly of FIG. 6.
Figure 10:
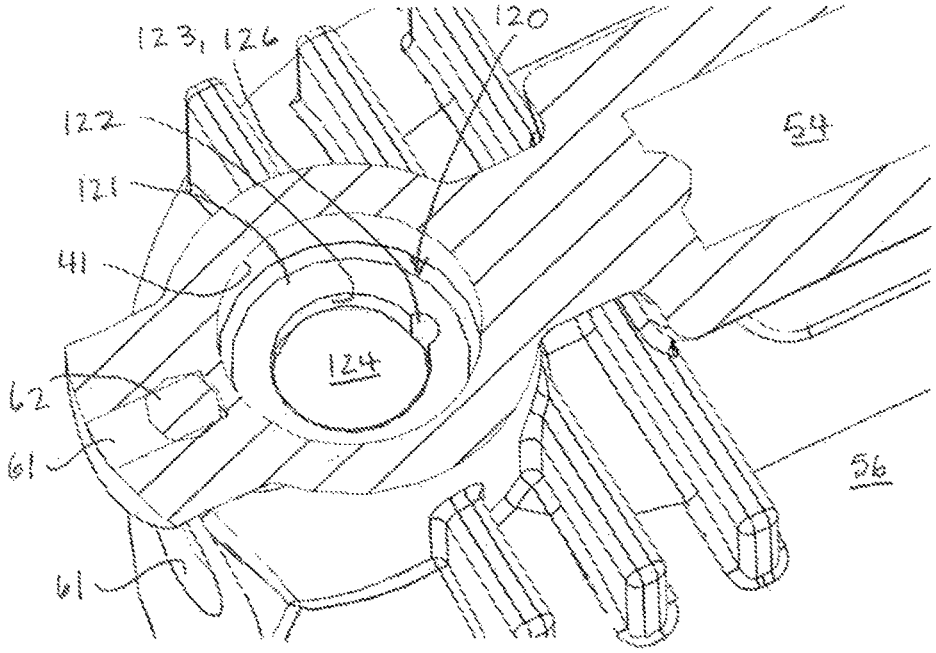
FIG. 10 is a cross sectional perspective view of a portion of the jet pump assembly as seen along line 10-10 of FIG. 9.

Referring to FIGS. 9 and 10, a jet pump choke 120 is disposed in the fuel supply conduit 41 between the secondary nozzle inlet 51 and the primary nozzle inlet 45. The jet pump choke 120 includes a choke housing 121 that is formed integrally with the inner surface of the fuel supply conduit 41, and a choke ball 124 that is disposed within the choke housing 121. The choke housing 121 defines a choke passageway 122. The choke passageway 122 extends between the fuel supply conduit 41 and the primary nozzle inlet 45, in parallel to a direction of fluid flow through the fuel supply conduit 41 and perpendicular to the primary nozzle longitudinal axis 47. A single choke slot 123 is formed in the choke passageway 122. The choke slot 123 extends in parallel to a direction of fluid flow through the fuel supply conduit 41.

The choke ball 124 is disposed in the choke passageway 122 at a location corresponding to the location of the choke slot 123. The choke ball 124 is dimensioned to be press fit within the choke passageway 122 such that the choke ball 124 is fixed within the choke passageway 122 and abuts the choke slot 123. In particular, the choke ball 124 is fixed within the choke passageway 122 and fully obstructs fluid flow within the choke passageway 122. However, a choke fluid path 126 is defined between the choke ball 124 and surfaces of the choke slot 123. The choke fluid path 126 provides fluid communication between the fuel supply conduit and the primary nozzle inlet 45.

Figure 11:
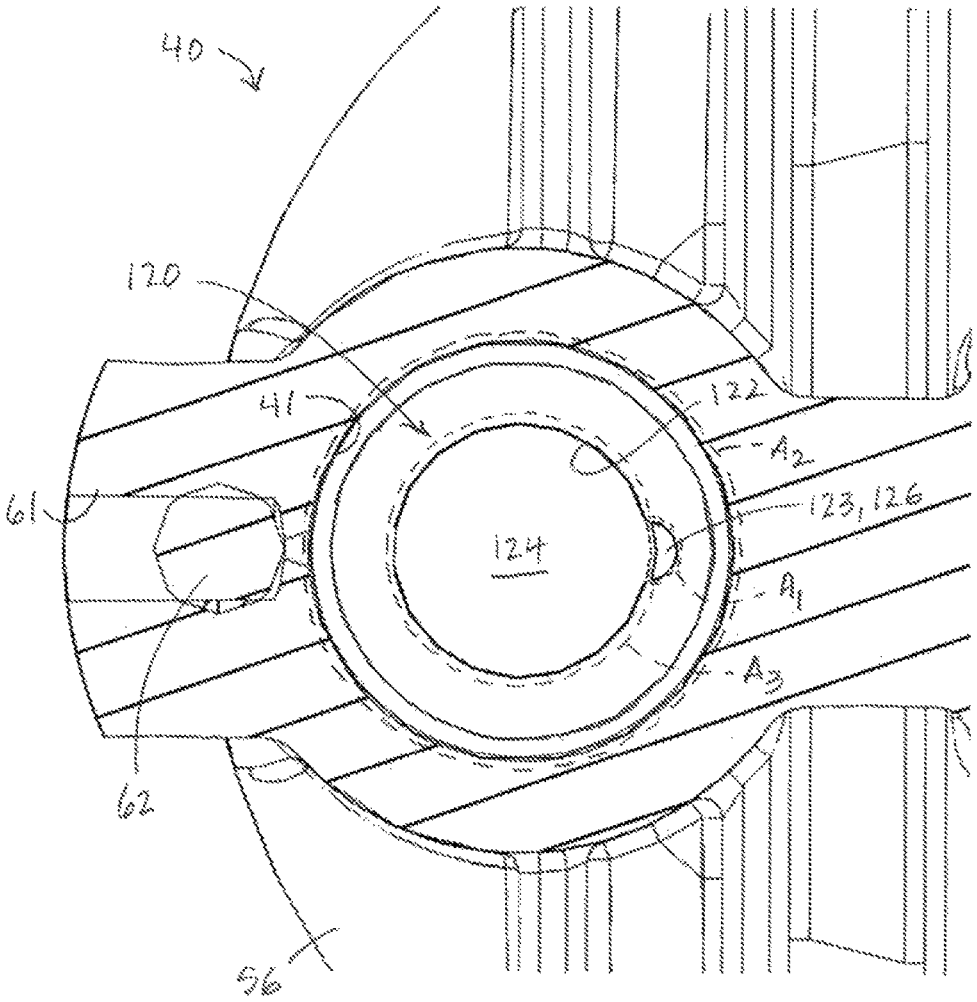
FIG. 11 is a cross sectional plan view of a portion of the jet pump assembly as seen along line 10-10 of FIG. 9.

Referring to FIG. 11, a cross-section of the choke fluid path 126 that is perpendicular to a direction of fluid flow through the choke fluid path 126 defines a first area A1. The first area A1 is small relative to a second area A2 that is defined by a cross-section of the fuel supply conduit 41 that is perpendicular to a direction of fluid flow through the fuel supply conduit 41, as well as a third area A3 that is defined by a cross-section of the choke passageway 122 that is perpendicular to a direction of fluid flow through the choke passageway 122. As a result, choke slot 123 serves a pressure reduction function. In particular, the jet pump choke 120 reduces the pressure of the pressurized fuel delivered to the primary nozzle inlet 45 relative to the pressure of the pressurized fuel delivered to the secondary nozzle inlet 51. The dimensions of the choke slot 123 are set based on an amount of pressure reduction that is required within the choke passageway 122 as determined by the specific application. For example, the jet pump choke 120 may reduce the pressure of the pressurized fuel delivered to the primary nozzle inlet 45 from about 3 bars to about 1 bar. Alternatively, the jet pump choke 120 may be configured to reduce the pressure of the pressurized fuel delivered to primary nozzle inlet 45 by a different amount.

Referring to FIGS. 5, 6 and 9, in the illustrated embodiment of the jet pump assembly 40, the mixing tubes 48, 54 of the primary and secondary jet pumps 43, 49 are stacked one on top of the other (i.e., vertically aligned) such that the mixing tubes 48, 54 share a common wall 64. Alternatively, the mixing tubes 48, 54 may be situated side-by-side or horizontally aligned, or situated diagonally with respect to one another, while sharing a common wall. Each of the primary and secondary jet pumps 48, 49 includes a plug (e.g., a ball bearing 62) positioned within an aperture 61 formed in a respective outer wall of the jet pumps 43, 49 while molding the fuel supply conduit 41, the base 56, and the jet pumps 43, 49 as a single piece. Specifically, the apertures 61 may be formed by respective slides used in an injection molding process to mold the passageways of the nozzles 44, 50 in the respective jet pumps 43, 49. As such, insertion of the ball bearings 62 into the apertures 61 (via an interference fit, for example) effectively blocks the apertures 61 to substantially prevent fuel flow through the apertures 61.

The jet pump assembly 40 also includes a plug 60 integrally formed as a single piece with the secondary jet pump 49. In the illustrated construction of the jet pump assembly 40, the plug 60 and the secondary mixing tube 54 are connected by an integral tether 63 to close an end 65 of the secondary mixing tube 54 opposite the secondary nozzle 50. As a result, fuel is prevented from being discharged from the end 65 of the secondary mixing tube 54. Alternatively, the plug 60 may be configured as a ball bearing that is a separate and distinct component from the secondary mixing tube 54.

The jet pump assembly 40 further includes an inlet conduit 58 integrally formed as a single piece with the secondary jet pump 49. The inlet conduit 58 fluidly communicates the secondary jet pump 49 and the secondary side 7 of the saddle-style fuel tank 4 to allow the secondary jet pump 49 to draw fuel from the secondary side 7 of the fuel tank 4. The inlet conduit 58 includes an opening 66 positioned adjacent the secondary nozzle 50 through which fuel is drawn into the secondary mixing tube 54 as a result of a low-pressure region surrounding the secondary nozzle 50 and in the inlet conduit 58 in response to fuel discharge through the secondary nozzle 50. In the illustrated construction of the jet pump assembly 40, the inlet conduit 58 extends substantially perpendicularly from the secondary mixing tube 54 and in a direction substantially parallel with the fuel supply conduit 41. Alternatively, the inlet conduit 58 may extend from the secondary mixing tube 54 at an oblique angle. The inlet conduit 58 includes a plurality of barbs 67 arranged about its outer peripheral surface that facilitate securing a rubber or plastic "crossover" tube 68 to the inlet conduit 58. Such a crossover tube 68 (shown schematically in FIGS. 3 and 4) extends from the inlet conduit 58, over the hump of the saddle-style fuel tank 4, and into the secondary side 7 of the fuel tank 4.

The jet pump assembly 40 may optionally include a bracket 57 integrally formed as a single piece with the inlet conduit 58. The bracket 534 includes a substantially circular cross-sectional shape and facilitates alignment of an inlet end of the fuel supply conduit 41 with the feed tube outlet 32.

The jet pump assembly 40 also includes a stand pipe 59 integrally formed as a single piece with the secondary jet pump 49. In the illustrated embodiment of the jet pump assembly 40, the stand pipe 59 extends substantially perpendicularly from the secondary mixing tube 54 and in a direction substantially parallel with the inlet conduit 58 and the fuel supply conduit 41. Alternatively, the stand pipe 59 may extend from the secondary mixing tube 54 at an oblique angle. The stand pipe 59 includes distal open end 69 that remains exposed or uncovered when the jet pump assembly 40 is positioned in the reservoir 8. As is described in more detail below, the stand pipe 59 substantially prevents fuel in the reservoir 8, below the distal open end 69 of the stand pipe 59 and outside of the jet pump assembly 40, from siphoning out of the reservoir 8 and into the secondary side 7 of the saddle-style fuel tank 4.

In operation of the fuel pump 12 and the jet pump assembly 40, some of the pressurized fuel output by the fuel pump 12 is diverted toward the jet pump assembly 40 to power the jet pump assembly 40 and fill the reservoir 8 with fuel (see FIG. 3). As discussed above, the pressure of the diverted fuel is reduced by the filtering choke 80 prior to entering the fuel supply conduit 41. The pressurized fuel in the fuel supply conduit 41 then feeds both the primary and secondary jet pumps 43, 49. As the pressurized fuel is discharged through the primary nozzle 44 of the primary jet pump 43, a low-pressure region within the internal chamber 42 of the base 56 is created, thereby opening the one-way valve 22 to allow fuel from the primary side 6 of the fuel tank 4 to be drawn into the internal chamber 42. Fuel drawn into the internal chamber 42 of the base 56 is mixed with the fuel discharged through the primary nozzle 44 in the primary mixing tube 48, and is subsequently discharged into the reservoir 8 to fill the reservoir 8. While this occurs, pressurized fuel discharged through the secondary nozzle 50 of the secondary jet pump 49 creates a low-pressure region surrounding the secondary nozzle 50 and within the inlet conduit 58, thereby drawing fuel from the secondary side 7 of the fuel tank 4 into the inlet conduit 58 (via the crossover tube 68). Fuel drawn through the inlet conduit 58 is mixed with fuel discharged through the secondary nozzle 50 in the secondary mixing tube 54, and the mixed fuel is discharged upwardly through the stand pipe 59 and into the reservoir 8 to fill the reservoir 8 with fuel from the secondary side 7 of the fuel tank 4.

Upon deactivation of the fuel pump 12, the one-way valve 22 closes to substantially prevent fuel in the reservoir 8 from back-flowing through the primary jet pump 43 and siphoning to the primary side 6 of the fuel tank 4. Some fuel in the reservoir 8 may, however, back-flow through the stand pipe 59, the secondary jet pump 49, and the inlet conduit 58 and siphon to the secondary side 7 of the fuel tank 4. As the level of fuel in the reservoir 8 reaches the distal open end 69 of the stand pipe 59, the remaining fuel in the stand pipe 59, the secondary jet pump 49, and the inlet conduit 58 may continue to siphon into the secondary side 7 of the fuel tank 4. However, any fuel in the reservoir 8 below the distal open end 69 of the stand pipe 59 and outside of the jet pump assembly 40 is prevented from siphoning into the secondary side 7 of the fuel tank 4, thereby maintaining a sufficient supply of fuel in the reservoir 8 in anticipation of reactivation of the fuel pump 12.

With reference to FIG. 4, operation of the jet pump assembly 40 is substantially similar as that described above with respect to FIG. 3, except the jet pump assembly 40 is powered by return fuel from the fuel pressure regulator 20 rather than receiving fuel directly from the output of the fuel pump 12.

Figure 12:
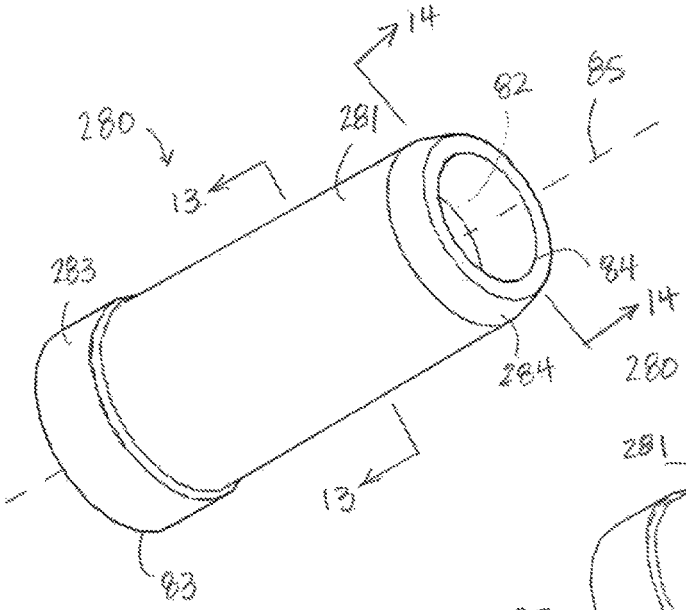
FIG. 12 is a perspective view of a filtering choke.
Figure 13:
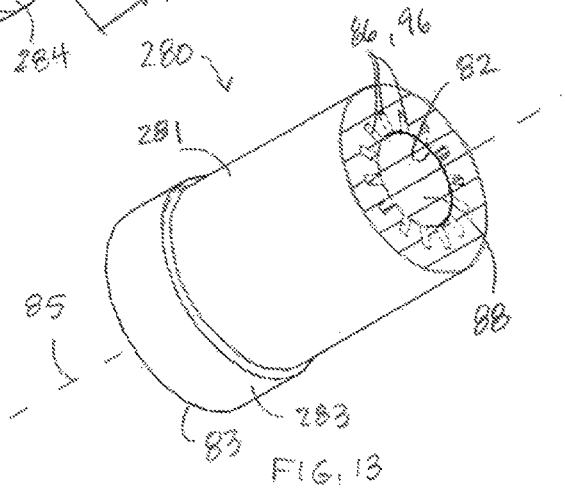
FIG. 13 is a cross-sectional view of the filtering choke as seen along line 13-13 of FIG. 12.
Figure 14:
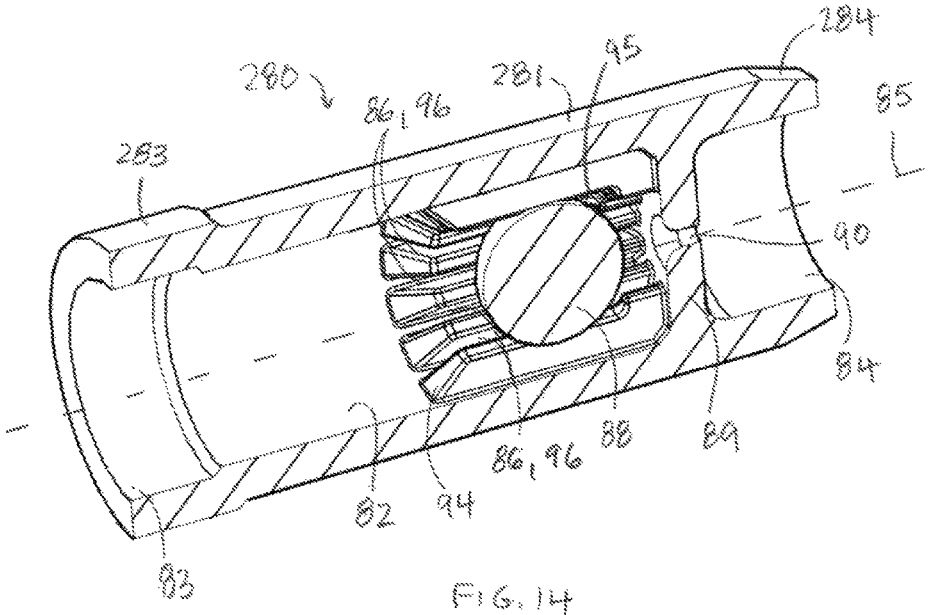
FIG. 14 is a cross-sectional view of the filtering choke as seen along line 14-14 of FIG. 12.

Referring to FIGS. 12-14, although in the illustrated embodiment, the filtering choke housing 81 is formed integrally with the jet pump feed tube 28, the filtering choke 80 is not limited to this configuration. For example, in some embodiments of the vehicle fuel pump module 2, an alternative embodiment filtering choke 280 is provided. The filtering choke 280 illustrated in FIGS. 12-14 is similar to the filtering choke 80 illustrated in FIGS. 7 and 8, and common elements have common reference numbers. However, the filtering choke 280 illustrated in FIGS. 12-14 differs from the earlier-described embodiment in that the filtering choke 280 has a filtering choke housing 281 that is formed separately from the feed tube 28, and is configured to be press fit within the feed tube passageway 34 during manufacture. To this end, the filtering choke housing 281 has an outer surface 282 that is shaped and dimensioned to a) facilitate insertion of the filtering choke housing 281 into the feed tube 28 during manufacture, and b) provide a sealed press fit within the feed tube passageway 34, whereby all fluid passing through the feed tube passageway 34 passes through the filtering choke housing 281. For example, the filtering choke housing outer surface 282 includes an annular protrusion 283 that is formed at the fluid inlet 83. The annular protrusion 283 has the same shape as the surface of the feed tube passageway 34, and a dimension that provides a sealed press fit therewith. In addition, the filtering choke housing outer surface 282 includes a radially inwardly tapered portion 284 formed at the fluid outlet 284. The tapered portion 284 of the filtering choke housing at the outer surface 282 does not intersect the choke housing passageway 282. The tapered portion 284 facilitates insertion of the filtering choke housing 281 into the feed tube 28 during manufacture.

Various features of the invention are set forth in the following claims.

We claim:

1. A vehicle fuel pump module comprising:

a reservoir configured to be disposed in a fuel tank of the vehicle; and a jet pump assembly that is disposed in the reservoir, wherein the jet pump assembly comprises:

a fluid supply conduit;

an internal chamber;

a primary jet pump including a primary nozzle and a primary mixing tube, the primary nozzle including a primary nozzle inlet that communicates with the fuel supply conduit and a tapered primary nozzle outlet, the primary mixing tube receiving fluid discharged from the primary nozzle outlet and being in fluid communication with the internal chamber; and a passageway that extends between the fuel supply conduit and the primary nozzle inlet, the passageway being parallel to a direction of fluid flow through the fuel supply conduit and perpendicular to a longitudinal axis of the primary nozzle, the passageway including a jet pump choke that is configured to provide a reduced pressure at the primary nozzle inlet relative to a pressure in the fluid supply conduit, the jet pump choke including a choke ball disposed in the passageway, and a choke slot that is formed in the inner surface of the passageway, the choke slot extending along a direction that is perpendicular to the longitudinal axis of the primary nozzle, wherein the choke ball is dimensioned to be press fit within the passageway such that the choke ball is fixed within the passageway and fully obstructs the passageway, and a fluid path is defined between the choke ball and surfaces of the choke slot, the fluid path providing fluid communication between the fuel supply conduit and the primary nozzle inlet.

2. The vehicle fuel pump module of claim 1, wherein a first area is defined by a cross section of the fluid path that is perpendicular to a direction of fluid flow through the fluid path, and a second area is defined by a cross section of the passageway that is perpendicular to a direction of fluid flow through the passageway, and the first area is less than the second area.

3. The vehicle fuel pump module of claim 1, wherein the jet pump assembly comprises a secondary jet pump that includes a secondary nozzle and a secondary mixing tube, the secondary nozzle including a secondary nozzle inlet that communicates with the fuel supply conduit and a tapered secondary nozzle outlet, the secondary mixing tube being configured to receive fluid that has been discharged from the secondary nozzle, and the jet pump choke is disposed between the secondary nozzle inlet and the primary nozzle inlet.

4. The vehicle fuel pump module of claim 3, wherein the secondary mixing tube is configured to receive a first portion of fluid that has been discharged from the secondary nozzle outlet and receive a second portion of fluid that is drawn from a portion of a fuel tank of the vehicle, and discharge the first and second portions of fluid to the reservoir.

5. The vehicle fuel pump module of claim 3, wherein the secondary mixing tube is configured to discharge fluid received from the secondary nozzle to the reservoir via a standpipe having an outlet that resides at location corresponding to an open end of the reservoir.

6. The vehicle fuel pump module of claim 1, comprising a jet pump feed tube that is connected to the jet pump assembly, the jet pump feed tube including a feed tube inlet, a feed tube outlet that is connected to and communicates with the fluid supply conduit, a feed tube passageway that extends between the feed tube inlet and the feed tube outlet, and a filtering choke disposed within the feed tube passageway at a location between the feed tube inlet and the feed tube outlet, the filtering choke including a choke housing that includes a fluid inlet, a fluid outlet, a choke housing passageway that extends between the fluid inlet and the fluid outlet, a choke housing longitudinal axis that extends between the fluid inlet and the fluid outlet, and a filter slot that is formed in a surface of the choke housing passageway, the filter slot extending in parallel to the choke housing longitudinal axis, and a filter ball disposed in the choke housing passageway, wherein the filter ball is dimensioned to be press fit within the choke housing passageway at a location corresponding to the location of the filter slot such that the filter ball is fixed within the choke housing passageway and abuts the filter slot, a fluid path is defined between the filter ball and surfaces of the filter slot, the fluid path providing fluid communication between the feed tube inlet and the feed tube outlet.

7. A vehicle fuel pump module comprising:

a reservoir configured to be disposed in a fuel tank of the vehicle; and a jet pump assembly that is disposed in the reservoir, wherein the jet pump assembly comprises:

a fluid supply conduit;

an internal chamber;

a primary jet pump including a primary nozzle and a primary mixing tube, the primary nozzle including a primary nozzle inlet that communicates with the fuel supply conduit and a tapered primary nozzle outlet, the primary mixing tube receiving fluid discharged from the primary nozzle outlet and being in fluid communication with the internal chamber;

a secondary jet pump that includes a secondary nozzle and a secondary mixing tube, the secondary nozzle including a secondary nozzle inlet that communicates with the fuel supply conduit and a tapered secondary nozzle outlet, the secondary mixing tube being configured to receive fluid that has been discharged from the secondary nozzle, and a jet pump choke that is disposed in the fuel supply conduit at a location between the secondary nozzle inlet and the primary nozzle inlet, the jet pump choke being configured to provide a reduced pressure at the primary nozzle inlet relative to a pressure in at the secondary nozzle inlet, the jet pump choke including a choke housing that defines a passageway, a choke ball disposed in the passageway, and a choke slot that is formed in the inner surface of the passageway, the choke slot extending along a direction that is perpendicular to the longitudinal axis of the primary nozzle, wherein the choke ball is dimensioned to be press fit within the passageway such that the choke ball is fixed within the passageway and fully obstructs the passageway, and a fluid path is defined between the choke ball and surfaces of the choke slot, the fluid path providing fluid communication between the fuel supply conduit and the primary nozzle inlet.

* * * * *